US005320741A

United States Patent [19]

Johnson et al.

[11] Patent Number: 5,320,741

[45] Date of Patent: Jun. 14, 1994

[54] COMBINATION PROCESS FOR THE PRETREATMENT AND HYDROCONVERSION OF HEAVY RESIDUAL OILS

[75] Inventors: Axel R. Johnson, N. Babylon, N.Y.; Elmo C. Brown, Houston, Tex.

[73] Assignee: Stone & Webster Engineering Corporation, Boston, Mass.

[21] Appl. No.: 865,317

[22] Filed: Apr. 9, 1992

[51] Int. Cl.[5] ..... C10G 67/02; C10G 29/04

[52] U.S. Cl. ..... 208/49; 208/252; 208/253

[58] Field of Search ..... 208/49, 100, 251 R, 208/252, 253, 58, 59

[56] References Cited

U.S. PATENT DOCUMENTS

| | | | |
|---|---|---|---|
| 3,705,850 | 12/1972 | Wolk | 208/157 |
| 3,725,251 | 4/1973 | Alpert et al. | 208/210 |
| 3,887,455 | 6/1975 | Hamner et al. | 208/59 |
| 3,901,792 | 8/1975 | Wolk et al. | 208/213 |
| 4,134,825 | 1/1979 | Bearden, Jr. et al. | 208/108 |
| 4,411,768 | 10/1983 | Unger et al. | 208/59 |
| 4,559,129 | 12/1985 | Reynolds et al. | 208/59 |
| 4,606,809 | 8/1986 | Garg | 208/59 |
| 4,657,664 | 4/1987 | Evans et al. | 208/211 |
| 4,657,665 | 4/1987 | Beaton et al. | 208/216 PP |
| 4,746,419 | 5/1988 | Peck et al. | 208/59 |
| 4,762,607 | 8/1988 | Aldridge et al. | 208/59 |
| 4,770,764 | 9/1988 | Ohtake et al. | 208/73 |
| 4,863,887 | 9/1989 | Ohtake et al. | 502/150 |
| 4,913,800 | 4/1990 | Sayles et al. | 208/108 |
| 4,941,964 | 7/1990 | Dai et al. | 208/216 |

OTHER PUBLICATIONS

CA Maomi Seko et al., "Super Oil Cracking (SOC), Latest Performance Proven High Conversion for Vacuum Residue" American Institute of Chemical Engineers, Spring National Mtg., Houston, Tex., Apr. 2-6, 1989.

*Primary Examiner*—R. Bruce Breneman
*Assistant Examiner*—Patricia L. Hailey
*Attorney, Agent, or Firm*—Hedman, Gibson & Costigan

[57] ABSTRACT

A novel method is disclosed for the hydroconversion of a heavy hydrocarbon feedstock wherein the feed is partially hydroconverted and demetalized in the presence of a catalytic additive and then the hydroconversion is completed in an ebullent bed reactor system.

22 Claims, 5 Drawing Sheets

COMBINATION PROCESS FOR THE PRETREATMENT AND HYDROCONVERSION OF HEAVY RESIDUAL OILS

The present invention relates to a novel method for the pretreatment and hydroconversion of heavy residual oils. More particularly, the present invention relates to a novel pretreatment and hydroconversion method which initially demetalizes a heavy residual feed by converting the hydrocarbon feed at low conversion level in the presence of a transition metal compound and ultra-fine particles and thereafter hydrogenates the demetalized feed in an expanded catalyst bed or similar reactor.

BACKGROUND OF THE PRESENT INVENTION

In recent years, with the shrinking supply of more valuable light hydrocarbon feedstocks, it has become increasingly important to employ heavy hydrocarbon feedstocks in the production of petrochemicals. This is especially the case due to the demand for light hydrocarbons, i.e. gaseous olefins such as ethylene, propylene, butadiene etc., monocyclic aromatics such as benzene, toluene and xylene etc. and naptha. Accordingly, methods for the production of these lighter petrochemicals form heavy feedstocks have been developed in the art.

However, in all of these processes, the thermal cracking of the heavy hydrocarbons results in significant amounts of coking which leads to a stoppage in production due to fouling of the process equipment. Further, in catalytic cracking, the heavy hydrocarbons often contain a large amount of metals which poison the catalyst, thus requiring expensive catalyst regeneration or replacement of the catalyst.

Recently, the production of lighter hydrocarbons has been reported with some success in a process which employs the addition of a transition metal catalyst complex and very fine particulates to the heavy hydrocarbon feedstock. See, U.S. Pat. Nos. 4,770,764 and 4,863,887. These processes have proved to be relatively insensitive to feed metals. See, FIG. 1, which shows in graphic form the percentage of demetalation as a function of conversion by these processes.

However, in these processes, as the conversion level is increased to above about 60%, a marked increase in coking is observed. See, FIG. 2, which shows, in graphic form, the percentage of coke yield as a function of percent conversion by these processes. Thus, there remains in the art a need for a process which can operate at high conversion without significant coke formation, yet have a reduced need for catalyst replacement due to poisoning.

To this end, the present Applicants have surprisingly found a novel process combination which satisfies these long felt needs in the art.

SUMMARY OF THE PRESENT INVENTION

It is therefore an object of the present invention to provide a process for the pretreatment and hydroconversion of heavy hydrocarbon feedstocks.

It is a further object of the present invention to provide a heavy hydrocarbon hydroconversion process which has a significantly improved reduction in the amount of coke produced.

It is another object of the present invention to provide a heavy hydrocarbon hydroconversion process which is relatively insensitive to the presence of metals in the feedstock.

It is still another object of the present invention to provide a process for the hydroconversion of heavy hydrocarbon feedstocks which can operate at high conversion levels.

It is a still further object of the present invention to provide a process for the hydroconversion of heavy hydrocarbon feedstocks which operates with substantially reduced catalyst poisoning.

These and other objects are provided by the present process which comprises (a) demetalizing a heavy hydrocarbon feedstock by hydroconverting the feedstock in the presence of an additive comprising a transition metal and very finely divided particles at a conversion rate of less than about 50%; and (b) hydrogenating said demetalized feedstock in an expanded (ebullated) catalyst bed reactor.

It is further contemplated that the effluent from the hydrogenation step (b) can then be employed as a feedstock for a downstream FCC process and/or separation process.

DETAILED DESCRIPTION OF THE PRESENT INVENTION

Figure 1:
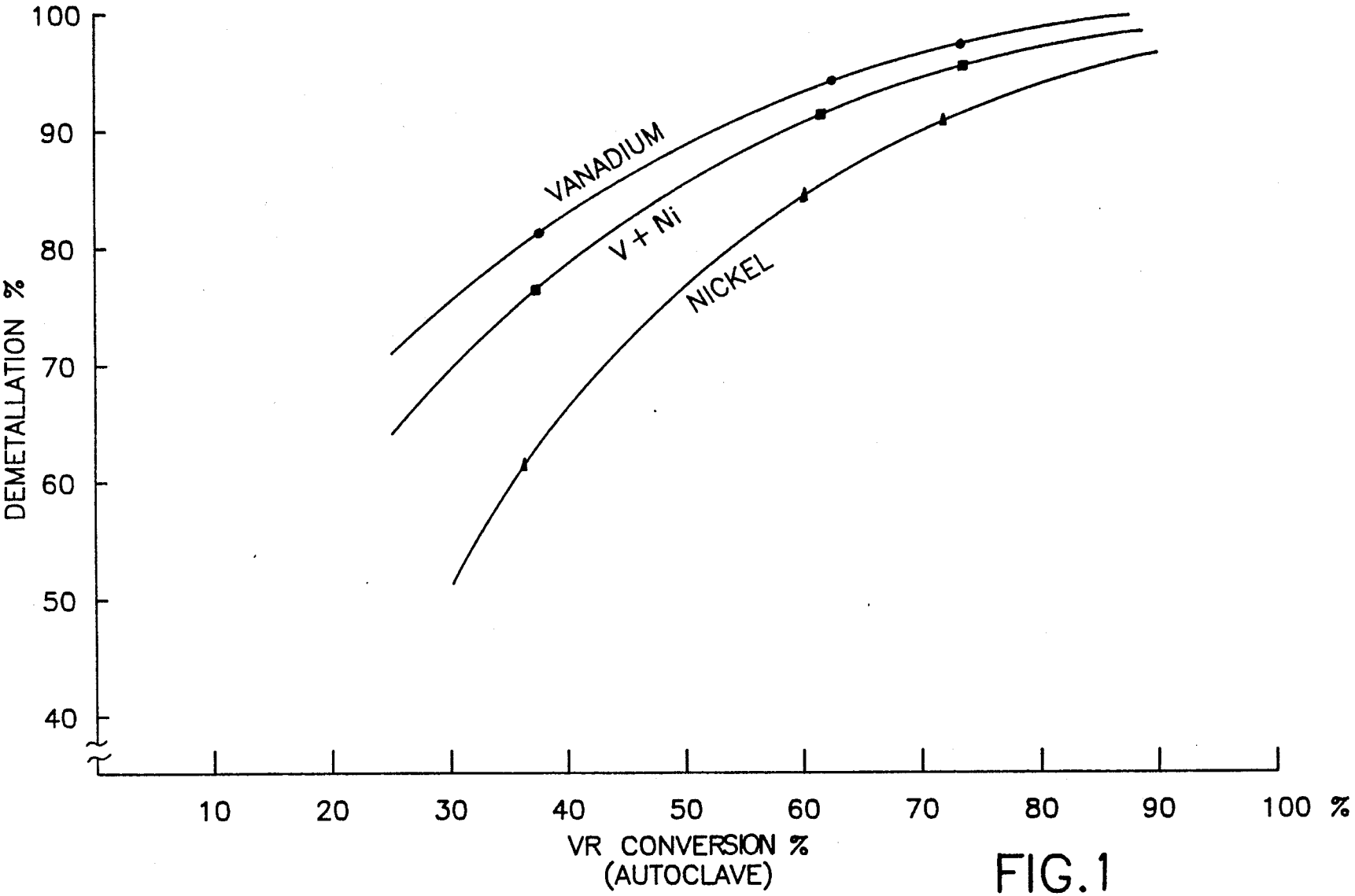
FIG. 1 depicts in graphic form the demetalation of a vacuum resid feedstock as a function of conversion according to the processes of the prior art, i.e., U.S. Pat. Nos. 4,863,887 and 4,770,764.
Figure 2:
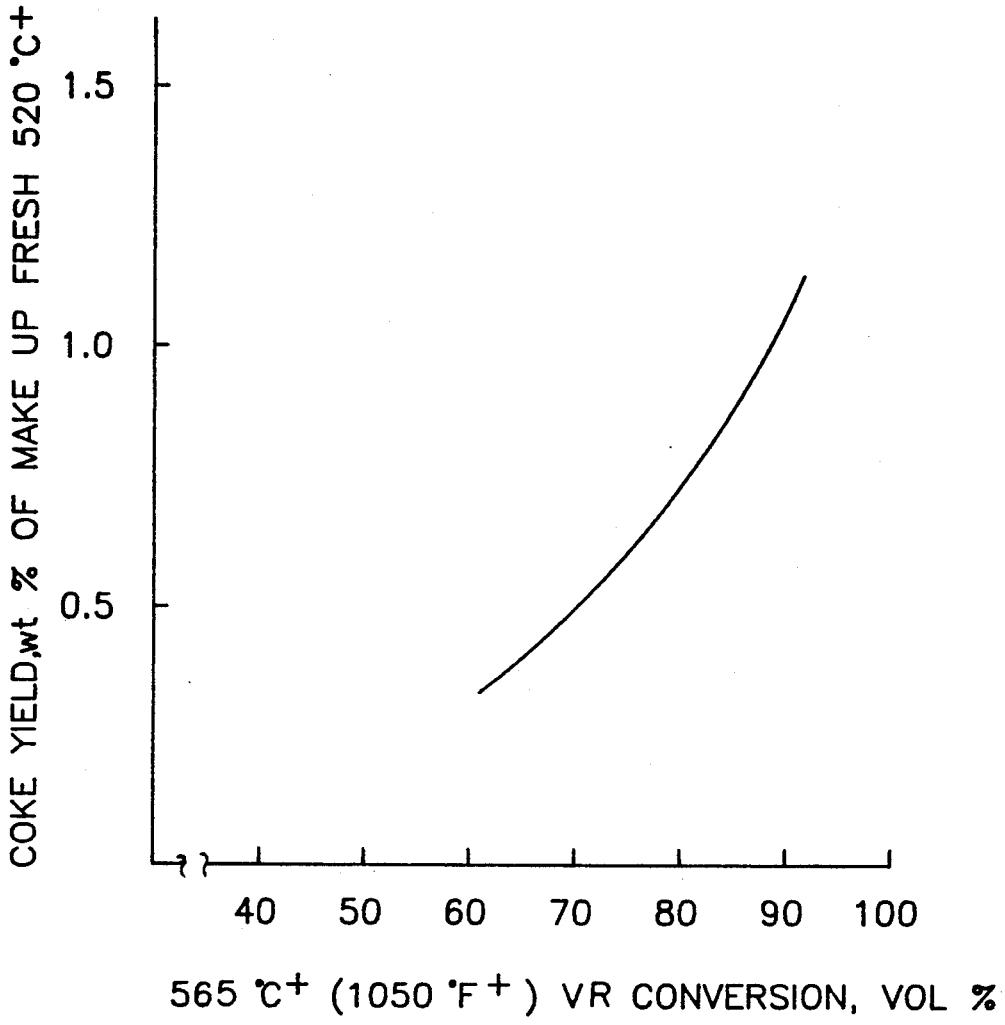
FIG. 2 depicts in graphic form the coke yield of a vacuum resid feedstock as a function of conversion according to the processes of the prior art, i.e., U.S. Pat. Nos. 4,863,887 and 4,770,764.

The present invention is an integrated process which combines a low conversion demetalizing process with a hydrogenation process such as an LC-Fining Process or H-Oil Process.

In the low conversion demetalizing process, a heavy hydrocarbon feedstock is hydroconverted at low conversion rates, on the order of 60% or less, in the presence of an additive.

The heavy hydrocarbon feedstocks useful in the practice of the present invention are generally those selected from a crude oil or an atmospheric residue or a vacuum residue of a crude oil. The heavy hydrocarbon feedstocks may also be selected from shale oil, tar sand and liquefied coal oil. The majority of the components of the heavy hydrocarbon feedstock generally have boiling points of above about 520° C.

The additives useful in the demetalizing step of the present invention are generally those described in U.S. Pat. Nos. 4,770,764 and 4,863,887.

A useful additive comprises two components. The first component (i) is an oil-soluble or water-soluble transition metal compound. These transition metals are selected from those of the group consisting of vanadium, chromium, iron, cobalt, nickel, copper, molybdenum, tungsten and mixtures thereof.

Examples of the oil-soluble compounds containing the desired transition metals are the so called $\pi$-complexes containing cyclopentadienyl groups or allyl groups as the ligand, organic carboxylic acid compounds, organic alkoxy compounds, diketone compounds such as acetylacetonate complex, carbonyl compounds, organic sulfonic acid or organic sulfinic acid compounds, xanthinic acid compounds such as dithiocarbamate, amine compounds such as organic diamine complexes, phthalocyanine complexes, nitrile or isonitrile compounds, phosphine compounds and others. Particularly preferable oil-soluble compounds are salts of aliphatic carboxylic acids such as stearic acid, octylic acid, etc., since they have high solubilities in oil, contain no hetero atoms, such as nitrogen or sulfur, and can be converted with relative ease to a substance having hydrotreating catalytic activity. Compounds of smaller molecular weight are preferred, because less amounts may be used for the necessary amounts of the transition metal.

Examples of water-soluble compounds are carbonates, carboxylates, sulfates, nitrates, hydroxides, halogenide and ammonium or alkali metal salts of transition metal acids such as ammonium heptamolybdenate.

Particularly useful for the practice of the present invention are solutions comprising at least one molybdenum compound selected from the group consisting of a heteropolyacid containing a molybdenum atom as the polyatom (hereinafter referred to as "heteropolymolybdic acid") and transition metal salts thereof, dissolved in an oxygen-containing polar solvent. A heteropolyacid is a metal oxide complex which is formed by the condensation of at least two kinds of inorganic acids, and has a distinctly unique anion structure and a crystalline configuration. A heteropolymolybdic acid used in the present invention is an acid type of a heteropolymolybdic anion. A heteropolymolybdic anion is formed by the condensation of an oxygen acid of molybdenum (polyatom) with an element of Groups I to VIII of the periodic table as a central atom (hetero atom). There are various heteropolymolybdic anions having different condensation ratios (atomic ratio of heteroatom to polyatom). Examples of the heteropolymolybdic anions include $(X^{+n}Mo_{12}O_{40})^{-(8-n)}$, $(X^{+n}Mo_{12}O_{42})^{-(12-n)}$, $(X^{+5}{}_2Mo_{18}O_{62})^{6}$, $(X^{+4}Mo_9O_{32})^{6}$, $(X^{+n}Mo_6O_{24})^{-(12-n)}$, $(X^{+n}Mo_6O_{24}H_6)^{-(6-n)}$ and anions which are formed by the partial degradation and those which are present in a solution, such as $(X^{+n}Mo_{11}O_{39})^{-(12-n)}$ and $(X^{+5}{}_2Mo_{17}O_{61})^{-10}$ (wherein X represents a heteroatom and n is a valence of X). The acid types of the heteropolymolybdic anions as mentioned above may be used in the present invention. Alternatively, the so-called mixed heteropolyacid may also be used in the present invention. The structures of the so-called mixed heteropolyacids are characterized in that in the case of the above-mentioned anions, part of molybdenum atoms (polyatoms) have been replaced by different transition metals such as tungsten and vanadium. Examples of such mixed heteropolyacids include acid types of anions $(X^{+n}Mo_{12-m}W_mO_{40})^{-(8-n)}$, $(X^{+n}Mo_{12-m}V_mO_{40})^{-8-n+m)}$ (wherein X and n are as defined above and m is an integer of 1 to 3) and the like. When m is an integer larger than 3 in the above-mentioned formulae of the anions of the so called mixed heteropolyacids, the catalytic activity decreases according to the increase of m. Representative examples of the anions include $(PMo_{12}O_{40})^{-13}$, $(SiMo_{12}O_{40})^{-4}$, $(GeMo_{12}O_{40})^{-4}$, $(P_2Mo_{18}O_{62})^{-6}$, $(CeMo_{12}O_{42})^{-8}$, $(PMo_{11}VO_{40})^{-4}$, $(SiMo_{11}VO_{40})^{-5}$, $(GeMo_{11}VO_{40})^{-5}$, $(PMo_{11}WO_{40})^{-3}$, $(SiMo_{11}WO_{40})^{-4}$, $(CoMo_6O_{24}H_6)^{-3}$, and reduced forms thereof. Further, although there are various heteropolyacids containing tungsten atoms only as polyatoms, such heteropolyacids are not preferred for use in the present invention because of the lower catalytic activity associated therewith. The heteropolymolybdic acids and mixed heteropolyacids may be employed alone or in mixture. In the present invention, the ratio of the number of molybdenum atoms to the total number of polyatoms is preferably at least 0.7.

Most of the above-mentioned heteropolymolybdic acids which may be used in the present application have an excellent oxidizing activity and are likely to be reduced to forms 2-, 4- or 6-electron reduced species (so-called heteropoly blue). For example, a heteropolymolybdic acid represented by the formula $H_3{}^{+3}(PMo_{12}O_{40})^{-3}$ is reduced to form $H_5{}^{+5}(PMo_{12}O_{40})^{-5}$ (2-electron reduced species), $H_7{}^{+7}(PMo_{12}O_{40})^{-5}$ (4-electron reduced species) or $H_9{}^{+9}(PMo_{12}O_{40})^{-9}$ (6-electron reduced species). Such 2-, 4- or 6-electron reduced species may also be used in the present invention. The above-mentioned reduced species of the heteropolymolybdic acid may be obtained by a customary electrolytic reduction method or a customary chemical reduction method in which various reducing agents are used.

In the present invention, transition metal salts of the above-mentioned heteropolymolybdic acid may also be employed. The transition metal salts of a heteropolymolybdic acid have a structure in which part or a whole of protons of a heteropolymolybdic acid are replaced by transition metal cations. Examples of the transition metal cations include $Cu^{2+}$, $Mn^{2+}$, $Ni^{2+}$, $Co^{2+}$, $Fe^{3+}$, $Cr^{3+}$, $Zn^{2+}$, and the like. The transition metal salts of a heteropolyacid may be produced by reacting a heteropolymolybdic acid with a transition metal carbonate or a transition metal nitrate in water. In the present invention, due to having poor catalytic activity, it is preferred not to use alkali metal salts containing $Na^{+}$, $K^{+}$, etc., and alkali earth metal salts containing $Mg^{2+}$, $Ca^{2+}$, etc., as the cations. Further, it is preferred not to use ammonium salts and alkyl ammonium salts of a heteropolymolybdic acid because such salts are also lower in catalytic activity.

The ultra fine powders useful as the second component in the additives of the present invention are those having an average particle size within the range of from about 5 to 1000 mμ which can be suspended in a hydrocarbon. These ultra fine powders are considered to prevent the coking phenomenon in the reaction zone, which is generally considered inevitable in converting heavy hydrocarbons into light hydrocarbons.

The ultra fine powders suitable for use in the present invention are generally either inorganic substances or carbonaceous substances. Illustrative of inorganic substances are the so-called fine ceramics such as ultra-fine particulate silicic acid, silicates, alumina, titania etc., and ultra-fine metal products such as those obtained via a vapor deposition process.

In embodiments wherein a solution comprising at least one molybdenum compound is employed, it is preferred that the ultra-fine powder comprise a powder of a carbonaceous substance having an average primary particle size of from about 1 to about 200 nm. These may be in the form of either primary particles (defined as particles which can be visually recognized as unit particles by means of an electron microscope) or secondary particles (granules of primary particles) and have an average primary particle size of from about 1 to 200 nm.

As the powder of a carbonaceous substance to be used in the present invention, it is desirable to use a powder of a carbonaceous substance which is substantially not reactive under the hydroconversion demetallization conditions, and which is more lipophilic and wettable with a hydrocarbon oil than the conventionally employed refractory inorganic substances. Therefore, it is preferred to use a powder of a carbonaceous substance consisting substantially of carbon and having an ash content as low as about 1% by weight or less. Such carbonaceous substances may be obtained by the carbonization of hydrocarbons. For example, a carbonaceous substance suitable for use in the present invention may be obtained by the so-called build-up process in which particles of a carbonaceous substance are produced through the formation of nuclei from molecules, ions and atoms and the subsequent growth of the nuclei, that is, by the carbonization of a hydrocarbon material in which the formation of carbonaceous substances is performed through the gaseous phase. Examples of powders of carbonaceous substances obtained by the above-mentioned method include pyrolytic carbon and carbon black. Further, powders of carbonaceous substance obtained as by-products in the water gas reaction or in the boiler combustion of hydrocarbons such as heavy oils and ethylene bottom oils, may also be used in the present invention as long as the average primary particle sizes thereof are within the range as mentioned above. Moreover, there may be employed coke and charcoal obtained by the carbonization of heavy oils in the liquid phase or solid phase as long as the ash contents thereof are as low as about 1% by weight or less and they can be pulverized to form particles having an average primary particle size in the range as mentioned above.

Of the powders of carbonaceous substances as mentioned above, the most preferred are carbon blacks. Various carbon blacks are known and commercially produced on a large scale, and they are classified as an oil furnace black, gas furnace black, channel black, thermal black and the like, according to the production method. Most of the carbon blacks have a structure in which the powder particles are chain-like linked by fusion, physical binding or agglomeration, and have an average primary particle size of from about 10 to 150 nm as measured by an electron microscope. Therefore, most of the commercially available carbon blacks can be advantageously used in the present invention.

A furnace black, which is most commonly used as carbon black, is classified as a non-porous substance, although it has a complicated microstructure comprised of an amorphous portion and a microcrystalline portion. Therefore, the surface area of a furnace black substantially depends on its primary particle size. Generally, the surface area of a furnace black may be about 50 to about 250 $m^2/g$ in terms of a value as measured by a BET method.

The additive comprising the transition metal compound and the powder compound can be added directly to the heavy hydrocarbon feedstock, or the additive components can be suspended in a hydrocarbon oil prior to the addition.

In the case wherein the additive comprises a molybdenum compound and the carbonaceous powder, it is preferred to suspend the components in a hydrocarbon oil, in order to provide an additive wherein the components are uniformly suspended and well contacted with each other. In order to disperse the molybdenum compound in a hydrocarbon oil uniformly in the colloidal form but not in the aggregate form, and to sufficiently contact the molybdenum compound with the powder of a carbonaceous substance, it is necessary that the molybdenum compound be dissolved in a solvent before it is suspended in a hydrocarbon oil together with the powder of a carbonaceous substance. Any solvent which is capable of dissolving the molybdenum compound may be employed. Examples of such solvents include oxygen-containing polar solvents such as water and an alcohol, ether and ketone of a lower alkyl. From the standpoint of economy, it is most preferred to use water as a solvent.

It is preferred that the molybdenum compound be dissolved in the oxygen-containing polar solvent at a concentration as high as possible, because the higher the molybdenum compound concentration in the solvent the smaller the amount of a solvent is used, which does not participate in the hydroconversion demetallization process step. The concentration of the molybdenum compound in the solvent varies according to the types of molybdenum compound and solvent used. Generally, the molybdenum compound may be dissolved in a solvent at a concentration of from about 10% by weight or more as molybdenum. However, the molybdenum compound concentration must not be so high that the molybdenum compound concentration is larger than the solubility of the compound which would result in the compound precipitating in the solvent. In view of the above, the upper limit of the molybdenum compound concentration is generally about 40% by weight as molybdenum although the upper limit is varied according to the types of the molybdenum compound and solvent used. In the case where a molybdenum compound in the solution is relatively unstable and is likely to decompose therein, the molybdenum compound must be promptly suspended in a hydrocarbon oil before the complete decomposition of the molybdenum compound occurs.

Alternatively, such a molybdenum compound may be stabilized by a customary method. For example, in the case of an aqueous solution of a heteropolymolybdic acid of the formula $H_3(PMo_{12}O_{40})$, a phosphate ion may be added to the solution as a stabilizing agent.

In preparing the additives of the present invention, the order of addition of the very fine powder and transition metal compound to the hydrocarbon oil feedstock is not critical, and they may be added simultaneously.

When the ultra-fine powders of the present invention are added to the feedstock of a heavy hydrocarbon, they may be added directly or they may be added as a concentrated dispersion in a different medium. The dispersion containing the ultra-fine powder may be subjected to mechanical operation such as by a stirrer, ultra-sonic wave or a mill, or alternatively in combination admixed with dispersants such as a neutral or basic phosphonate, a metal salt such as a sulfonic acid of calcium or barium, succinimide and succinate, benzylamine or a polypolar type polymeric compound.

It is also contemplated by the present invention to suspend both the transition metal compound and very fine powder in a hydrocarbon oil prior to addition to the feedstock. The hydrocarbon oil useful as a suspending medium are those derived from a petroleum which contains a sulfur compound and a nitrogen compound.

These may include fuel oils or may also include a portion of the oil which is to be used as a feedstock.

In the embodiments where the transition metal compound is a molybdenum compound and the very fine powder is a carbonaceous substance, the suspension in the hydrocarbon oil enables the components to come into contact to form a colloidal compound having as a skeletal structure an anion of the heteropolymolybdic acid and thereby forms a peculiar slurry. The slurry can then undergo a suspending operation to ensure proper contacting between the powder and molybdenum compound. The suspension operation may advantageously be carried out by a customary technique, for example by using a disperser or a mill which is capable of generating a high shearing force, and, if desired, by using an emulsifier, or a surfactant such as a petroleum sulfonate, fatty acid amide, naphthenate, alkyl sulfosuccinate, alkyl phosphate, ester of a fatty acid with polyoxyethylene, polyoxyethylene sorbitan fatty acid ester, ester of a fatty acid with glycerol, a sorbitan fatty acid ester and a polycarbonic acid-amine salt type high molecular weight surfactant.

The ratio of the powder of a carbonaceous substance to the molybdenum compound to be suspended in a hydrocarbon oil may be varied according to the type of the carbonaceous substance and the molybdenum compound used. Generally, it is preferred that the weight amount of a molybdenum compound, calculated as the weight of molybdenum, be smaller than the weight of the powder of the carbonaceous substance.

The total concentration of the powder of a carbonaceous substance and the molybdenum compound suspended in a hydrocarbon oil may be varied according to the types of the carbonaceous substance, the type of molybdenum compound, the solvent for the molybdenum compound and the hydrocarbon oil used. The total concentration employed should be determined in view of the balance between the scale of additive preparation and the facility of slurry handling. Generally, a total concentration of from about 2 to about 20 weight percent of additive is employed based on the weight of the additive and hydrocarbon oil combined.

The substance suspended in the additives of the present invention is not a catalyst but is a catalyst precursor. However, when the additive containing the catalyst precursor is used for hydroconversion, the molybdenum compound in the catalyst precursor reacts with the sulfur or the sulfur compound contained in the hydrocarbon oil used for suspending the powder and molybdenum compound and/or the heavy hydrocarbon oil to be used as a feedstock for the hydroconversion. Alternatively, the precursor reacts with the hydrogen sulfide gas produced by the hydroconversion of the heavy hydrocarbon oil during the pre-heating of a mixture of heavy hydrocarbon oil and additive and/or during the hydroconversion reaction, thereby to form molybdenum sulfide. The thus obtained suspended substance containing the molybdenum sulfide acts as a catalyst of the hydroconversion of a heavy hydrocarbon oil In order to ensure the formation of molybdenum sulfide form the molybdenum compound, sulfur or a sulfur compound may be added to the slurry obtained by suspending the powder of a carbonaceous substance an ht solution of a molybdenum compound in a hydrocarbon oil. Examples of sulfur compounds include thiophenol, methylthiophene, diethylthiophene, thionaphthene, disphenylene sulfide, diethyl sulfide and the like. Of the sulfur and sulfur compounds, the most preferred is sulfur. It is sufficient that the sulfur or sulfur compound is added in an amount of 2 gram atoms or more of sulfur per gram atom of molybdenum. The upper limit of the amount of sulfur or sulfur compound is not critical. Generally, the upper limit may be about 4 gram atoms of sulfur per gram atom of molybdenum so that part or all of the sulfur or sulfur compound introduced is reacted with the molybdenum compound at the time of the hydroconversion of a heavy hydrocarbon oil. However, int he case were transition metals other than, or in addition to, molybdenum, are use, the amount of the sulfur or sulfur compound to be added may be increased taking into consideration the formation of sulfides of transition metals other than molybdenum. In the case of the sulfur, the form of the sulfur to be added is not critical. However, from the standpoint of dispersibility or solubility in a hydrocarbon oil, it is preferred that the sulfur may be in the form of powder having a particle size of, for example, 100 mesh (Tyler) (147 nm or less).

Incidentally, it should be noted that a chelating sulfur compound such as a tetraalkylthiuram disulfide and a dialkyldithiocarbonate are into desirable for use as the sulfur compound because such a chelating sulfur compound reacts with the molybdenum compound to form an undesirable coordination compound and complex in which a heteropolymolybdic anion structure no longer exists, thus leading to a decrease in catalytic activity.

Further, the additive of the present invention which contains the catalyst precursor may be heated in an atmosphere containing no oxygen, preferably in an atmosphere of hydrogen gas so that he molybdenum compound in the catalyst precursor reacts with the sulfur or sulfur compound present int he hydrocarbon oil to form an amorphous molybdenum sulfide. The temperature of the heat treatment of the additive is not critical. Generally, the temperature may be from about 350° C. to 500° C. The thus formed amorphous molybdenum sulfide has an excellent catalytic activity for the hydroconversion. The term "amorphous" as used herein means that no crystals are detected according to X-ray diffractometry. In this connection, it should be noted that if the molybdenum compound is not uniformly dispersed in the additive slurry, a crystalline molybdenum sulfide is formed by the heat treatment of the additive. The formation of such a crystalline molybdenum sulfide is not desirable because the catalytic activity decreases.

Using the above-mentioned additives of the present invention, the demetallization of the heavy hydrocarbon oil can be effectively conducted. The amount of the additive to be added to the heavy hydrocarbon oil may be varied depending upon the type of very fine powder, type of transition metal compound, the type of feedstock and the type of reaction apparatus employed. In general, the amount of transition metal compound varies between about 1 and about 1000 parts per million by weight (ppm), more preferably from about 5 to about 500 ppm, based on the total weight of the feedstock and additive. The powder substance concentration that varies from about 0.005 to about 10 weight percent, and more preferably from about 0.02 to about 3% by weight, is generally employed.

After the addition of the additive to the raw heavy hydrocarbon oil, the resulting mixture is heated in the presence of a hydrogen gas or hydrogen gas-containing gas to conduct the demetallization and partial hydroconversion of the feedstock. Generally the demetallization and hydroconversion may conducted at a temperature of about 300° to about 550° C., a pressure of about 30 $Kg/cm^2$ to about 300 $Kg/cm^2$, a residence time of from about 1 minute to 2 hours, and a hydrogen gas introduced in an amount ranging from 100 to 4,000 $Nm^3/kl$.

It is essential however that the process parameters, i.e., type of additive, additive concentration, temperature, pressure and residence time, be selected such that the total conversion of the heavy hydrocarbon oil, where conversion is defined according to the following formula:

$$1 - \frac{\text{proportion of fraction having b.p. of 520° C. or higher in product}}{\text{proportion of fraction having b.p. 520° C. or higher in feedstock}} \times 100$$

be less than 60%, more preferably from about 40 to about 60%, and most preferably from about 50 to about 60%. In this manner, coke yields are sufficiently low and metal removal rates are high. Moreover, the additive dosage rates are significantly reduced below the levels required to provide 80–90% conversion.

The hydroconversion/demetallization can be conducted using any conventional reaction apparatus as long as the apparatus is suitable for conducting the slurry reaction Examples of typical reaction apparatus include, but are not limited to, a tubular reactor, a tower reactor and a soaker reactor.

Although the hydroconversion/demetallization can be conducted in a batchwise manner, it may also be conducted in a continuous manner. Accordingly, a heavy hydrocarbon oil, an additive and a hydrogen-containing gas are continuously supplied to the reaction zone in a reaction apparatus to conduct a partial hydroconversion and concurrent demetallization of the heavy hydrocarbon oil while continuously collecting the upgraded feedstock.

The upgraded feedstock is then conveniently directly introduced into an ebullated bed reactor system. The upgraded feedstock, with significantly reduced process metals, enables the ebullated bed reactor system to be operated in an enhanced catalytic environment, as opposed to the more typical thermal environment.

The ebullated bed reactor systems are well known in the art, and generally comprise introducing a hydrogen-containing gas and heavy hydrocarbon feedstock into the lower end of a generally vertical catalyst containing reaction vessel wherein the catalyst is placed in random motion within the fluid hydrocarbon whereby the catalyst bed is expanded to a volume greater than its static volume. Such processes are described in the literature, e.g. U.S. Pat. Nos. 4,913,800, 32,265, 4,411,768 and 4,941,964. They are commercially known as the H-Oil Process (Texaco Development Corp.) and LC-Fining Process (ABB Lummus Crest, Inc.). See, Heavy Oil Processing Handbook, pages, 55–56 and 61–62.

Typically, the catalyst employed in the ebullated bed are the oxides or sulfides of a Group VIB metal of a Group VIII metal. Illustratively, these include catalysts such as cobalt-molybdate, nickel-molybdate, cobalt-nickel-molybdate, tungsten-nickel sulfide, tungsten sulfide, mixtures thereof and the like, with such catalysts generally being supported on a suitable support such as alumina or silica-alumina.

In general, the reaction conditions in the ebullated reactor system comprise temperatures in the order of from about 650° to 900° F., preferably from about 750 to about 850° F., operating pressure of from about 500 psig to about 4000 psig, and hydrogen partial pressures generally being ranging from about 500 to 3000 psia.

The upgraded feedstock from the partial hydroconversion/demetalization step is hydroconverted to levels ranging from 80 to 90% and greater in the ebullated bed reactor. The converted effluent from the ebullated bed reactor can then be fed as an upgraded feedstock to a downstream FCC process or separation process, or both, as is well known to those skilled in the art.

The combined process of the present invention therefore provides a hydroconversion method which operates at very high hydroconversion rates to produce a high quality product having low levels of sulfur and nitrogen contaminants, and is further effective for reducing catalyst consumption, coke yields, and hydrogen consumption.

The process of the present invention is effective in converting heavy hydrocarbon feedstocks containing relatively high metals contents, e.g. vacuum resid from Arabian Heavy Crude.

DESCRIPTION OF THE PREFERRED EMBODIMENTS

Figure 3:
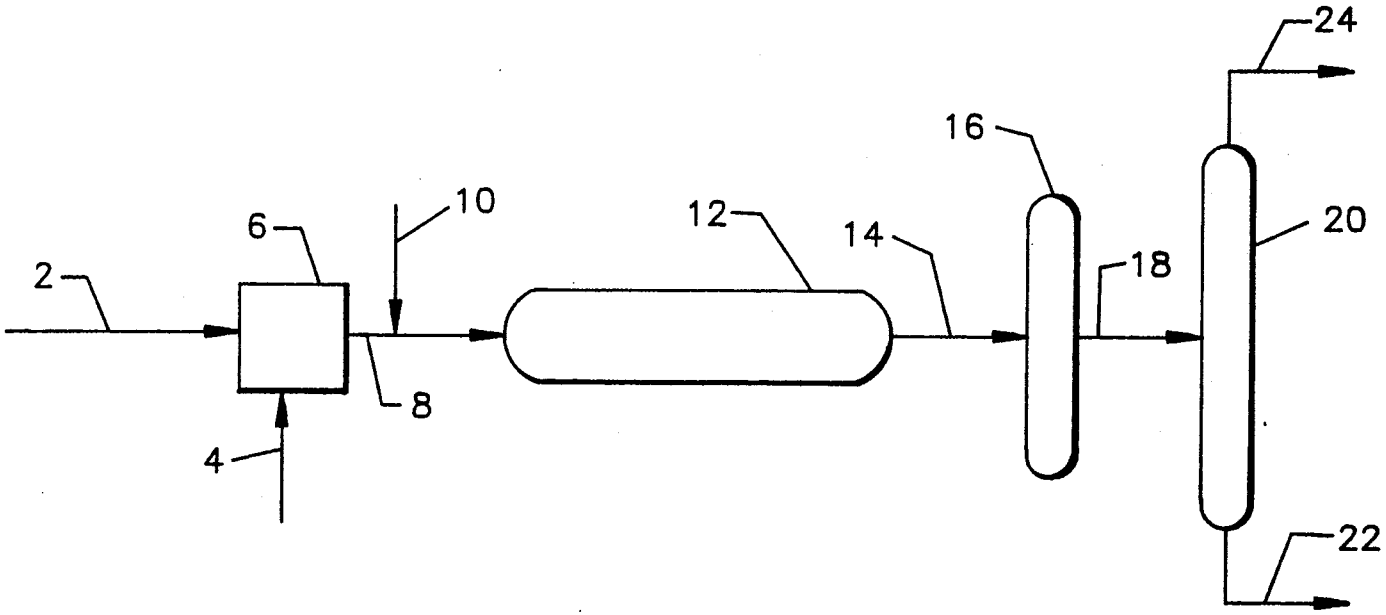
FIG. 3 is a general flow diagram of the process of the present invention.

The process of the present invention is generally shown in FIG. 3. A heavy hydrocarbon feedstock in a line 2 is mixed in a mixer 6 with an additive from a line 4. The mixture in a line 8 is then fed to a tubular reactor 12 with a hydrogen-containing gas from a line 10. The tubular reactor 12 operates at a conversion of from about 50 to about 60%. The partially converted heavy hydrocarbon effluent in a line 14 is then directly fed to an ebullent reactor system 16 (see FIG. 4) wherein the conversion is completed. The converted hydrocarbon is then withdrawn in a line 18 a directed to a downstream separation process 20 for separation into lighter components 24 and heavier components 22.

Figure 4:
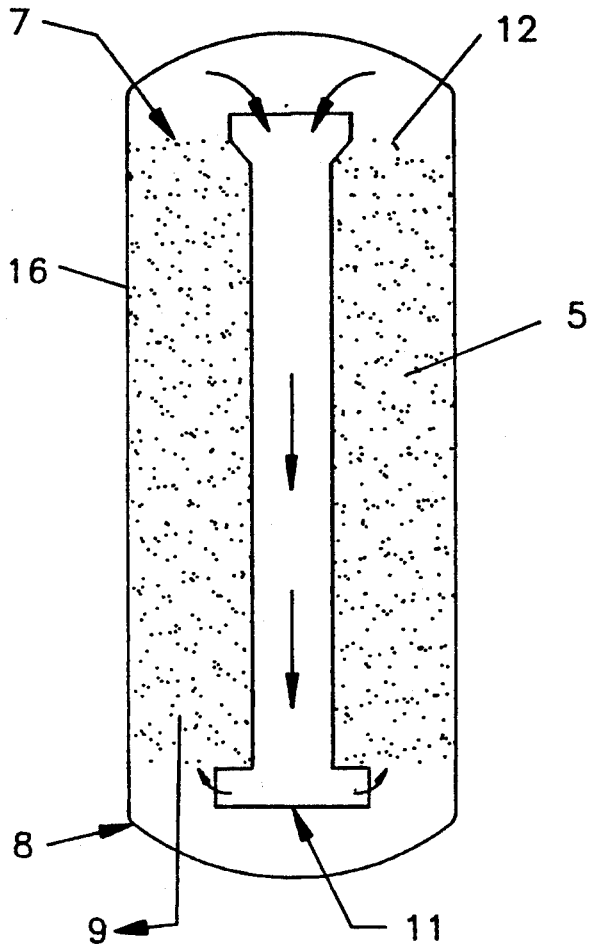
FIG. 4 is a flow diagram of an ebullent bed reactor useful in the practice of the present invention.

A typical ebullent bed reactor, useful in the practice of the present invention, is shown in FIG. 4. An expanded bed of catalyst 5 is contained within the reactor 16 with means for catalyst addition 7 and catalyst withdrawal 9. The partially converted heavy hydrocarbon is fed to the reactor 16 via a line 8, with recirculation of the hydrocarbon provided by recycle pump means 11. The converted hydrocarbon is then withdrawn from the reactor via a line 18.

Figure 5:
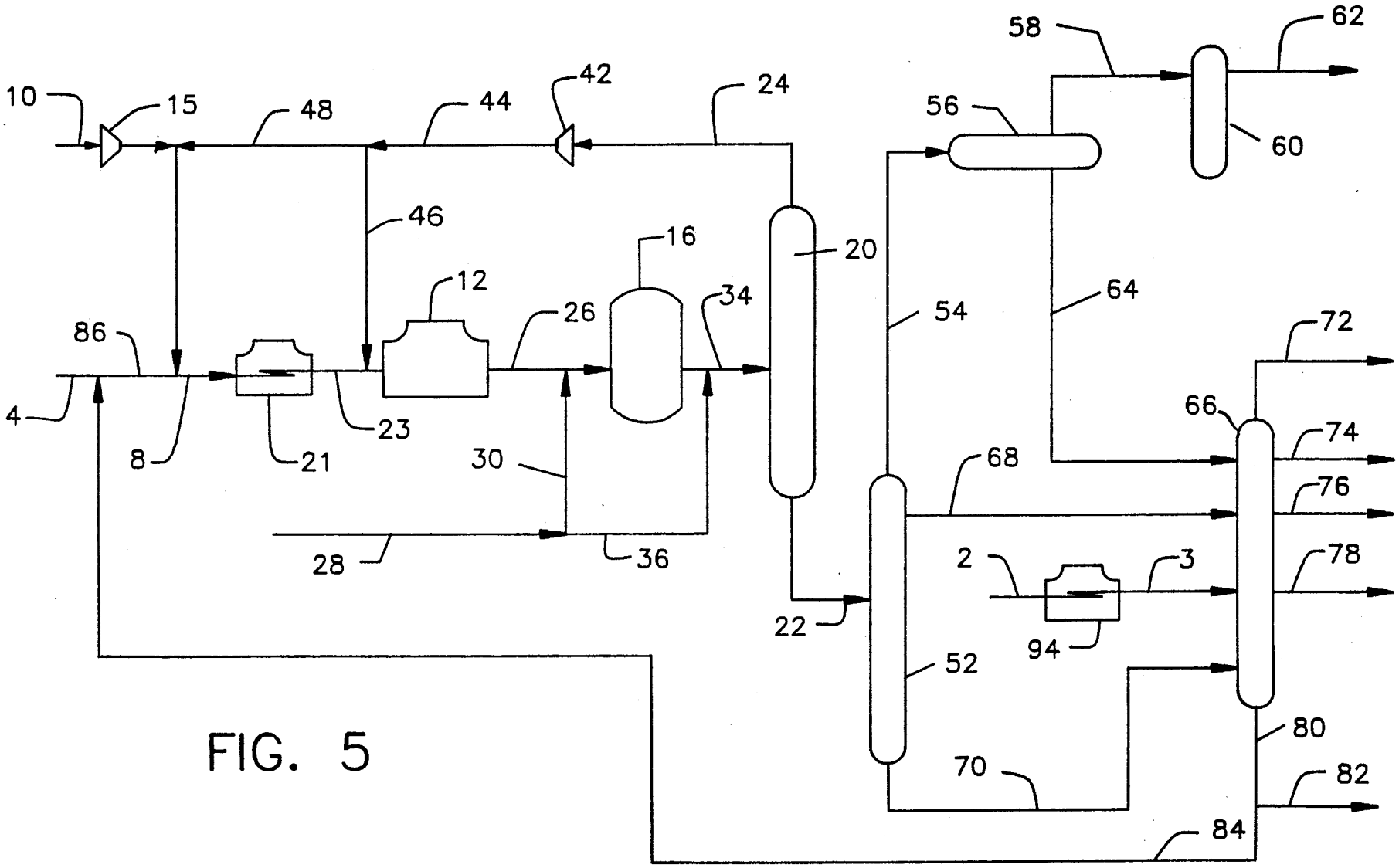
FIG. 5 is a flow diagram of a preferred embodiment of the present invention.

In a preferred embodiment, referring to FIG. 5, the heavy hydrocarbon feedstock in a line 2 is fed to a preheater 94 and directed to a vacuum column 66 via a line 3 to remove any light components. The heavy hydrocarbon oil is withdrawn from the vacuum column 66 in a line 80. A stream 82 containing cracked vacuum residue is withdrawn from the heavy hydrocarbon oil 80 in a line 82. The heavy hydrocarbon oil is recycled via a line 84 and contacted with the fine powder/transition metal additive from a line 4 to form the stream 86.

Hydrogen containing gas in a line 10 is passed through a compressor 15 and mixed with the additive/-heavy hydrocarbon oil in a line 8. The mixture in the line 8 is then preheated in a preheater 21 and the preheated mixture is withdrawn in a line 23. Additional hydrogen containing gas is added through a line 46 and the mixture is fed to the demetalizer/partial hydroconverter reactor 12, operating at conditions such that the conversion of the heavy hydrocarbon oil is from about 40 to about 60%.

A quench oil from a source 28 is added to the effluent 26 from the demetalizer/partial hydroconverter through a line 30, to quench the conversion. The quenched partially converted hydrocarbon oil is then fed directly into a ebullated bed reactor 16 to complete the conversion. The converted hydrocarbon oil is withdrawn in a line 34, quenched via quench oil from a line 36 and fed to the separator 20 for separation into a gaseous stream 24 and a liquid stream 22.

The gaseous stream 24 is compressed in recycle gas compressor 42 and recycled as a hydrogen-containing gas for use in the partial hydroconversion via lines 46 and 48.

The liquid stream 22 is fed to a downstream product recovery system. The liquid stream 22 is first fed into an atmospheric tower 52 for further separation into a gaseous stream in a line 54 and two liquid streams, 68 and 70. The gaseous stream in a line 54 is directed to a naphtha stabilizer vessel 56 to recover any naphtha remaining in the stream in a line 64. The gas is removed from the stabilizer vessel 56 in a line 58 and is directed to an amine absorber 60 before being removed in a line 62 as an off-gas.

The intermediate liquid from the atmospheric tower 52 is directed to an upper portion of a downstream vacuum flasher tower 66 via a line 68, while the heavier liquid from the atmospheric tower 52 is directed to a lower portion of the vacuum flasher 66 via the line 70. Additionally, recovered naphtha from the naphtha stabilizer 56 is directed to the top of the vacuum flasher 66 via the line 64.

The vacuum flasher 66 separates the feedstreams into various components, a vent gas in a line 72, a naphtha stream in a line 74, a gas oil in a line 76, a vacuum gas oil in a line 78 and a vacuum resid in a line 80, which is recycled to the reactor system.

The above mentioned patents and publications are hereby incorporated by reference.

Many variations of the present invention will suggest themselves to those skilled in the art in light of the above-detailed description. All such obvious modifications are within the full intended scope of the appended claims.

We claim:

1. A method for the hydroconversion of a heavy hydrocarbon feedstock comprising:

(a) demetallizing and partially converting a heavy hydrocarbon feedstock comprising a fraction having a boiling point higher than 520° C. by a process comprising:

(i) admixing with said heavy hydrocarbon feedstock an additive comprising (1) a water or oil soluble transition metal compound and (2) an ultra fine powder selected from fine ceramics and carbonaceous substances having an average particle size of from about 5 to 1000 mμ;

(ii) hydroconverting the admixture in a reactor int he presence of a hydrogen-containing gas at a temperature ranging from about 300° to about 550° C., a pressure ranging from about 30 $Kg/cm^2$ to about 300 $Kg/cm^2$, and a residence time ranging from about 1 minute to about 2 hours such that the percentage conversion is less than about 60%;

(iii) removing a partially converted effluent at a conversion of less than about 60% from the reactor;

(b) feeding said partially converted effluent to a hydrogenation zone wherein effluent is introduced into a catalyst containing reaction vessel; and (c) recovering a converted hydrocarbon oil.

2. A method as defined in clam 1 wherein said heavy hydrocarbon feedstock is selected from crude oil, atmospheric residue of a crude oil, vacuum residue of a crude oil, shale oil, tar sand oil, liquefied coal oil and mixtures of any of the foregoing.

3. A method as defined in claim 1 wherein said additive comprises a suspension in a hydrocarbon oil of (1) a solution comprising at least one molybdenum compound selected from the group consisting of a heteropolyacid containing a molybdenum atom as a polyatom and a transition metal salt thereof, dissolved in an oxygen-containing polar solvent; and (2) a carbon black having an average particle size of from about 1 to 200 nm; wherein in said suspension the weight mount of said molybdenum compound calculated as weight of molybdenum is smaller than the weight amount of said carbon black.

4. A method as define in claim 3 wherein said oxygen-containing polar solvent is water.

5. A method as define in claim 1 wherein said percentage conversion in said step (a)(ii) is from about 40 to about 60%.

6. A method as define in claim 5 wherein said percentage conversion in said step (a)(ii) is from about 50 to about 60%.

7. A method as define in claim 1 further comprising quenching the partially converted effluent in step (a)-(iii).

8. A method as defined in claim 1 wherein said catalyst contained in the reaction vessel of step (b) is selected from oxides or sulfides of Group VIB or Group VIII metals.

9. A method as define in claim 8 wherein said catalyst is selected from the group consisting of cobalt-molybdate, nickel-molybdate, cobalt-nickel-molybdate, tungsten-nickel sulfide, tungsten-sulfide and mixtures of any of the foregoing.

10. A method as defined in claim 1 wherein said hydrogenation zone (b) operates at a temperature ranging from about 650° to about 900 F., a pressure ranging from about 500 psig to about 4000 psig, and a hydrogen partial pressure of from about 500 to about 3000 psia.

11. A method as define in claim 1 wherein said water soluble transition metal compound comprises a compound selected from the group consisting of carbonates, carboxylates, sulfates, nitrates, hydroxides, halogenides and ammonium or alkali metal salts of transition metals and mixture of any of the foregoing.

12. A method as define in claim 11 wherein said transition metal is selected from the group consistent of vanadium, chromium, iron, cobalt, nickel, copper, molybdenum, tungsten and mixtures thereof.

13. A method as define in claim 12 wherein said water soluble transition metal compound comprises ammonium heptamolybdenate.

14. A method as define in claim 1 wherein said oil soluble transition metal compound comprises a transition metal compound selected form the group consisting of organic carboxylic acid compounds, organic alkoxy compounds, diketone compounds, carbonyl compounds, organic sulfonic acid or organic sulfinic compounds, xanthinic acid compounds, amine compounds, nitrile or isonitrile compounds, phosphine compounds and mixtures of any of the foregoing.

15. A method as define in claim 14 wherein said transition metal is selected from the group consisting of vanadium, chromium, iron, cobalt, nickel, copper, molybdenum, tungsten and mixtures thereof.

16. A method as define in claim 15 wherein said oil-soluble transition metal compounds are transition metal compounds of salts of aliphatic carboxylic acids.

17. A method as define in claim 1 wherein said carbonaceous ultra fine powder comprises carbon black.

18. A method as define in claim 1 wherein said ultra fine ceramics comprises ultra fine particulate silicic acid, silicate, alumina, titania and mixtures of any of the foregoing.

19. A method for the hydroconversion of a heavy hydrocarbon feedstock comprising:

(a) demetallizing and partially converting a heavy hydrocarbon feedstock comprising a fraction having a boiling point higher than 520° C. by a process comprising (i) admixing with said heavy hydrocarbon feedstock an additive comprising a suspension in a hydrocarbon oil of (1) a solution comprising at least one molybdenum compound selected from the group consisting of a heteropolyacid containing a molybdenum atom as a polyatom and a transition metal salt thereof, dissolved in an oxygen-containing polar solvent; (2) a carbon black having an average particle size of from about 1 to 200 nm; and further comprising adding sulfur or a sulfur compound to said suspension in an amount of two gram atoms or more of sulfur per gram atom of molybdenum, and dispersing said sulfur or sulfur compound in said suspension;

(ii) hydroconverting the admixture in a reactor in the presence of a hydrogen-containing gas at a temperature ranging from about 300° to about 550° C., a pressure ranging from about 30 $Kg/cm^2$ to about 300 $Kg/cm^2$, and a residence time ranging from about 1 minute to about 2 hours such that the percentage conversion is less than about 60°;

(iii) removing a partially converted effluent from the reactor;

(b) feeding said partially converted effluent to a hydrogenation zone wherein the partially converted effluent is introduced into a catalyst containing reaction vessel; and (c) recovering a converted hydrocarbon oil.

20. A method for the hydroconversion of a heavy hydrocarbon feedstock comprising (a) demetalizing and partially converting a heavy hydrocarbon feedstock comprising a fraction having a boiling point higher than 520° C. by a process comprising:

(i) admixing with said heavy hydrocarbon feedstock an additive comprising (1) a water or oil soluble transition metal compound and (2) an ultra fine powder selected from fine ceramics and carbonaceous substances having an average particle size of from about 5 to 1000 mμ;

(ii) hydroconverting the admixture in a reactor int he presence of a hydrogen-containing gas at a temperature ranging from about 300° to about 550° C., a pressure ranging from about 30 $kg/cm^2$ to about 300 $kg/cm^2$, and a residence time ranging from about 1 minute to about 2 hours wherein the percentage conversion is less than about 60%;

(iii) removing a partially converted effluent at a conversion of less than about 60% from the reactor;

(b) feeding said partially converted effluent to a hydrogenation zone wherein effluent is introduced into a catalyst containing reaction vessel and hydroconverting at a temperature ranging form about 750° to about 850° F.

21. A method for the hydroconversion of a heavy hydrocarbon feedstock comprising:

(a) demetallizing and partially converting a heavy hydrocarbon feedstock comprising a fraction having a boiling point higher than 520° C. by a process comprising:

(i) admixing with said heavy hydrocarbon feedstock an additive comprising (1) a water or oil soluble transition metal compound and (2) an ultra fine powder selected from fine ceramics and carbonaceous substances having an average particle size of from about 5 to 1000 mμ;

(ii) hydroconverting the admixture in a reactor int he presence of a hydrogen-containing gas at a temperature ranging from about 300° to about 550° C., a pressure ranging from about 30 $kg/cm^2$to about 300 $kg/cm^2$, and a residence time ranging from about 1 mixture to about 2 hours such that the percentage conversion is less than about 60%;

(iii) removing a partially converted effluent at a conversion of less than about 60% from the reactor;

(b) feeding said partially converted effluent to a hydrogenation zone wherein the effluent is introduced into the lower end of a generally vertical reaction vessel having a static volume catalyst bed wherein said catalyst bed is placed in random motion within the fluid hydrocarbon and whereby the catalyst bed is expanded to a volume greater than the static volume of the catalyst bed; and (c) recovering a converted hydrocarbon oil.

22. In a method for the hydroconversion of a heavy hydrocarbon feedstock comprising a conversion step of adding to the heavy hydrocarbon an additive comprising a water or oil soluble transition metal compound and an ultra fine powder selected from fine ceramics and carbonaceous substances having an average particle side of from about 5 to about 1000 mμ and converting the admixture in a reactor int he presence of a hydrogen-containing gas at a temperature ranging from about 300° to about 550° C. and a pressure ranging from about 30 $kg/cm^2$ to about 300 $kg/cm^2$;

the improvement comprising:

carrying out said conversion step to a conversion of less than about 60% an removing the partially converted effluent at a conversion of less than about 60% from said reactor; and completing the conversion said hydroconversion by hydrogenating said partially converted effluent in a hydrogenation zone comprising introducing said partially converted effluent into a catalyst containing vessel and hydrogenating said partially converted effluent.

* * * * *